US007819204B2

(12) United States Patent
Bamford

(10) Patent No.: US 7,819,204 B2
(45) Date of Patent: Oct. 26, 2010

(54) SUBSEA DRILLING

(75) Inventor: Anthony S. Bamford, Montrose (GB)

(73) Assignee: Geoprober Drilling Limited, Aberdeenshire (GB)

( * ) Notice: Subject to any disclaimer, the term of this patent is extended or adjusted under 35 U.S.C. 154(b) by 391 days.

(21) Appl. No.: 11/658,359

(22) PCT Filed: Jul. 25, 2005

(86) PCT No.: PCT/GB2005/002885

§ 371 (c)(1),
(2), (4) Date: Jan. 23, 2007

(87) PCT Pub. No.: WO2006/010906

PCT Pub. Date: Feb. 2, 2006

(65) Prior Publication Data

US 2008/0121429 A1 May 29, 2008

(51) Int. Cl.
*E21B 7/12* (2006.01)

(52) U.S. Cl. ..... 175/5; 166/338; 166/339; 166/340; 166/358

(58) Field of Classification Search ..... 175/5–10, 175/67; 166/338–340, 344, 345, 351, 361, 166/360, 367, 358
See application file for complete search history.

(56) References Cited

U.S. PATENT DOCUMENTS 2,182,797 A * 12/1939 Dillon ..... 285/308
3,489,210 A * 1/1970 Wakefield, Jr. ..... 166/352
3,603,409 A * 9/1971 Watkins ..... 175/7
3,741,320 A 6/1973 Hilfing
3,825,065 A * 7/1974 Lloyd et al. ..... 166/351
4,813,495 A * 3/1989 Leach ..... 175/6
5,184,686 A * 2/1993 Gonzalez ..... 175/5
5,533,574 A * 7/1996 Gonzalez ..... 166/358

(Continued)

FOREIGN PATENT DOCUMENTS

EP 0 709 545 A2 5/1996

(Continued)

OTHER PUBLICATIONS

Edi Sutriono et al., Drilling with Casing Advances to Floating Drilling Unit with Surface BOP Employed, World Oil Casing Drilling Technical Conference, 2003, pp. 1-7, WOCD-0307-01.

(Continued)

*Primary Examiner*—Thomas A Beach
*Assistant Examiner*—Matthew R Buck
(74) *Attorney, Agent, or Firm*—Sughrue Mion, PLLC

(57) ABSTRACT

A method and apparatus for drilling subsea wells is provided. A subsea shut off device including ball gripping mechanisms is latched to a template at surface. Drilled in casing can be suspended from the device at any position using the gripping mechanism so that the device is run to the sea floor on the casing string. The casing string is drilled into place and converted into a riser. This is all done on a single trip to speed up the operation and reduce the risk. The casing string is captured and sealed within the subsea shut-off device after installing and spacing out a surface BOP. For the event when emergency disconnection is required, dual shear rams in the device cut the casing and seal in the well. The system then allows a conventional subsea reconnection of the riser.

36 Claims, 9 Drawing Sheets

U.S. PATENT DOCUMENTS

| | | | | |
|---|---|---|---|---|
| 5,819,852 | A * | 10/1998 | Cunningham et al. | 166/345 |
| 6,672,390 | B2 * | 1/2004 | Azancot | 166/341 |
| 6,745,853 | B2 * | 6/2004 | Turner et al. | 175/5 |
| 6,805,200 | B2 * | 10/2004 | DeBerry | 166/347 |
| 7,267,179 | B1 * | 9/2007 | Abel | 166/379 |
| 7,367,410 | B2 * | 5/2008 | Sangesland | 175/7 |
| 2003/0051879 | A1 | 3/2003 | Azancot | |

FOREIGN PATENT DOCUMENTS

| | | |
|---|---|---|
| EP | 0 713 951 A2 | 5/1996 |
| WO | WO 02/088516 A1 | 11/2002 |

OTHER PUBLICATIONS

Dave McKay et al., New Developments in the Technology of Drilling with Casing: Utilizing a Displaceable DrillShoe Tool, World Oil Casing Drilling Technical Conference, 2003, pp. 1-12, WOCD-0306-05.

Armel Simondin et al., Surface BOP with mudline shut-off device: A deepwater well construction alternative, World Oil, Jan. 2005, pp. 49-52.

* cited by examiner

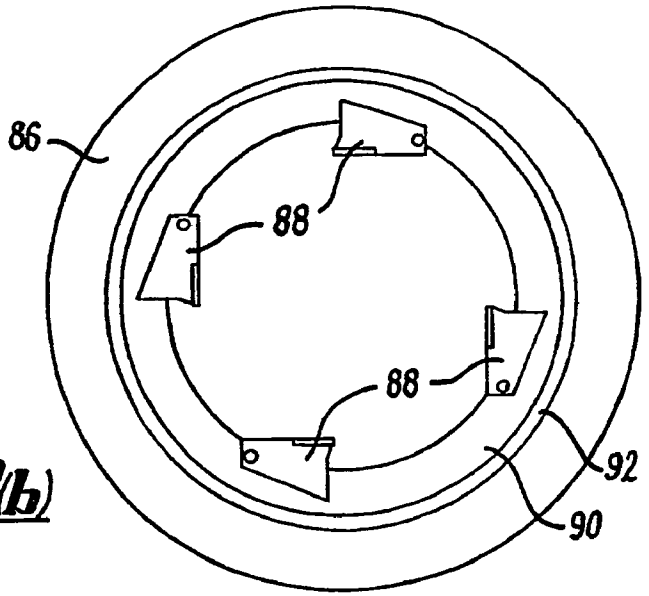
FIG. 3(b)
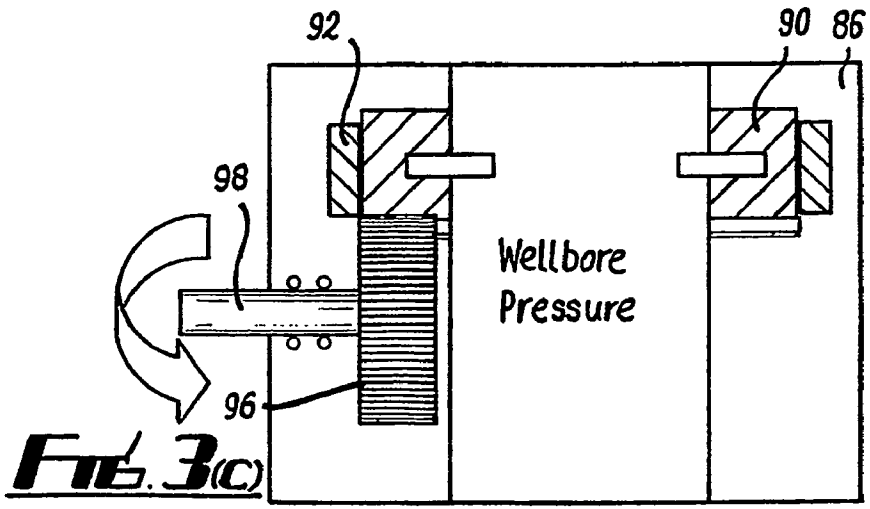
FIG. 3(c)
FIG. 3(a)
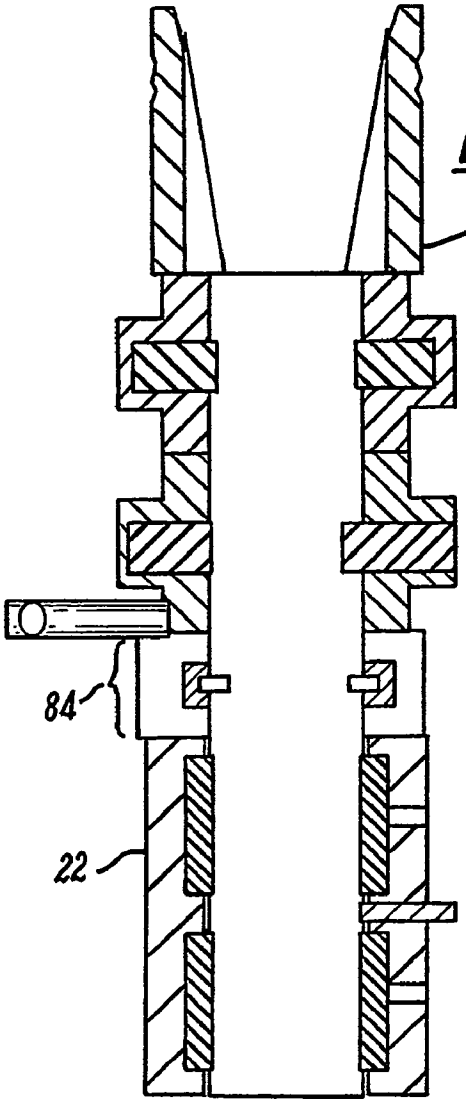

SUBSEA DRILLING

BACKGROUND OF THE INVENTION

The present invention relates to subsea drilling of oil and gas wells and in particular, though not exclusively, to apparatus and method for a one trip deployment and drilling system to rapidly create exploration wells.

Current practice in subsea drilling is to firstly establish a well by drilling a surface hole at the sea floor. Conductor casing is cemented at the top of the well upon which is located a subsea wellhead. Thereafter a Subsea Blowout Preventer Stack (BOP) is run and latched to the wellhead. Subsequent casing strings are then suspended in the wellhead.

In many exploration wells drilled from floating vessels, the current trend is to use a BOP at the vessel rather than at the sea floor. This is done to reduce the number of trips required to the sea floor and reduce the complexity of the procedure. However, this arrangement is only acceptable for some situations where the vessel is moored in benign metocean conditions. Where there is a risk that the vessel may loose station over the well, especially where it is maintained on station over the well by dynamic positioning, a shut off device at the sea floor is being seen as a minimum requirement. The shut off device must be capable of providing rapid disconnection between the riser, attaching the well to the vessel, and the wellhead.

WO 02/088516 to Shell International Research Maatschappij B.V. describes a system for drilling a subsea well, comprising a surface BOP, a subsea BOP connected to the wellhead and a drilling riser there between. Drilling is achieved by running a drill string through the riser. The subsea BOP includes a selective disconnection system so that the riser can be disconnected in the event of the vessel/platform moving. While this system addresses requirement for a subsea shut-off device it has the inherent disadvantage in the time taken to establish a well as the wellhead is installed before the subsea BOP is located and connected to the riser. Finally the drill string is run through the connected riser.

Running a shut off device down to a subsea wellhead saves little time over current subsea drilling practices.

It is therefore an object of the present invention to provide a method of establishing a subsea well where the shut-off device is run-in with the drilling assembly so that the well is drilled and established on a single trip without the need to first drill and locate a wellhead.

A further object of the present invention is to provide a subsea shut off device which can be run on casing and released so that the casing can be used for drilling the well.

SUMMARY OF THE INVENTION

According to a first aspect of the present invention there is provided a method of drilling a subsea well comprising the steps:

a) providing a subsea shut off device including a throughbore, a first gripping mechanism for selective attachment to casing when located in the throughbore and one or more rams for selectively sealing the throughbore in an emergency;

b) providing a casing string upon which the shut off device is attached thereto by the first gripping mechanism;

c) running the casing string with the shut off device from the surface to the sea floor;

d) disconnecting the casing string from the shut off device;

e) using the casing string to drill the well from the sea floor.

This method can be performed in a single trip so that drilling starts immediately when the shut off device and the casing string are released from each other. The casing string may be referred to as drilled-in casing as is known in the art. A BOP may be connected to the casing string on the vessel or other mobile arrangement moored at sea.

This method is particularly suited to areas where the hole size can be reduced and only a limited number of small diameter casing strings is required to reach the productive formation. Such an application could be a disposable exploration ("Finder") well where there is no intention to use the well for producing oil and gas.

Preferably the method includes the step of re-engaging the first gripping means during drilling of the well. This step is only undertaken if the sea floor becomes unstable and it is desired to support the weight of the shut-off device from the vessel or other moored platform from which the device was deployed.

Preferably the method includes the step of attaching a template to the shut off device at the surface, before deployment to the sea floor. Advantageously the template is attached to an outer surface of the shut off device by a second gripping mechanism. The template distributes the load of the shut off device and the casing string on the sea floor when the shut off device is located at the sea floor.

Preferably the first and second gripping mechanisms are ball gripping mechanisms. Such a ball gripping mechanism may be as described in U.S. Pat. No. 2,182,797 to Dillon. The drilled-in casing can thus be suspended from the shut off device at any point along it's length.

Preferably also the method includes the step of suspending a section of casing from the template. Preferably the casing is a short section of large diameter casing. This larger casing with the attached template provides structural support for the shut off system, both when the well is established and during the process of drilling in the main casing. Advantageously a portion of the shut off device is located within the larger section of casing.

Preferably also the method includes the step of jetting the larger section of casing into the sea floor. Preferably also this step includes the step of circulating fluid through the casing string. The larger section of casing may also be cemented in place.

This method allows the well to be established with small diameter high pressure casing, typically 7-⅝" in diameter whilst at the same time running the novel shut-off device down and into the seafloor. After the shut off device has been jetted in and secured to the seafloor, the casing may be disconnected and the casing can be drilled to depth typically 1,500-2500 ft below the mudline. The maximum depth is normally determined by the need for blowout prevention.

In an alternative embodiment the method may include the steps of:

a) supporting the shut off device on a vessel;

b) running the casing string through the shut off device;

c) drilling the subsea well with the casing string to a desired depth; and d) pulling back the casing string through the shut off device;

e) setting the gripping means and extruding annular seals;

f) running the now attached shut off device to the sea floor;

g) reciprocating the shut off device with the attached casing whilst circulating fluid through the casing and up the annulus to the sea floor, thereby creating an oversized hole;

h) anchoring the shut off device in the hole; and i) cementing the annulus.

This allows the subsea well to be initially 'spudded' so that the shut off device can be inserted into the sea floor easily.

Such a method is required where the sea floor comprises harder stiffer soils e.g. North Sea and the East Coast of Canada. In this embodiment the section of larger casing may be a conductor having a shoe at an end thereof. In this way the shoe can be reciprocated in the well to aid entry of the conductor into the sea floor.

Preferably also the casing string includes a drill shoe on end thereof. Advantageously the drill shoe is extrudable. In this way, on reaching maximum depth, the drillshoe can be extruded as part of the cementing process, permitting the next bit and drilling assembly to be inserted through the casing. Reference is made to World Oil Paper Numbers WOCD-0306-05 and WOCD-0307-01, Gulf Publishing Company.

Preferably the method includes the step of activating a first seal at a lower end of the shut off device. This creates a seal between the casing string and the shut off device to prevent cutting returns from entering the shut off device. This first seal may be a low pressure seal.

Preferably the method includes the steps of spacing out the casing string and supporting the casing by a third gripping mechanism. The third gripping mechanism may work in the reverse direction to the first gripping mechanism. In this way the casing between the surface and the sea floor is supported by the well shut off device. The method may also include the step of tensioning the casing string at the surface. This may be achieved with conventional hydro-pneumatic tensioners. Further the casing may be cemented in place.

Preferably the method includes the step of activating two or more second seals to create a high pressure seal between the casing string and the shut off device. Preferably also the method includes the step of pressure testing the second seals. Thus the casing string can be converted to a high pressure riser on completion of this phase of drilling. The riser provides a continuous conduit through the water column to the surface. Advantageously, the method may include the step of injecting a liquid sealant into the seals, in the event that the pressure test fails. The method may also include the step of retesting the seals.

The method may also accommodate an alternative casing drilling method, as are known in the art, whereby the bottom hole assembly is inserted through the casing, so as to place the bit, under-reamer, motor and any open hole logging devices required, in the open hole. This is advantageous for the alternative embodiment as the bit can be replaced if prematurely worn before the desired depth is achieved. The bottom hole assembly may be retrieved on coiled tubing or wirelineattached thereto.

The method may include the step of activating a lower set of shear rams, of the one or more rams, to shear the casing string and seal the through bore. This would be used in an emergency where the vessel has drifted from the well. The step of shearing may include shearing any string located within the casing string. The method may also include the step of activating an upper set of shear rams, of the one or more rams, to shear the casing string and seal the through bore in the event of failure of the lower shear rams. Preferably also the method includes the step of holding pressure using the second seals following disconnection by severing of the casing.

In an alternative embodiment the method may include the step of locating a weak point of the casing string between the first and third gripping mechanisms and between the second seal, with the third gripping mechanism arranged above the first and between the second seals. In this way, the casing section can be caused to fracture when the emergency disconnect is required. The method would thus preferably include the steps of:

(a) disengaging the third gripping mechanism and the upper second seal;

(b) severing the casing string at the weak point;

(c) raising the severed upper portion of the casing string above the rams; and (d) closing the rams to seal the well bore.

Preferably the method also includes the step of reconnecting a casing string to the shut off device. In this way the well can be re-established by deploying a conventional wellhead connector attached to casing or a conventional riser. Reconnection on the alternative embodiment is now easier due to the controlled cutting of the casing without crushing the casing. Additionally the cutting does not have to take place under well pressure.

The method may also include the steps of plugging and abandoning the well by:

a) cutting the casing string below the second gripping mechanism;

b) releasing the first and third gripping mechanisms; and c) pulling the shut off device together with the section of large diameter casing, to surface.

In this way the shut off device is retrievable for re-use. The template may be left on the sea floor by release of the second gripping mechanism.

According to a second aspect of the present invention there is provided a subsea shut off device comprising a substantially tubular body having an axial throughbore; a first gripping mechanism for selective engagement to casing when inserted in the throughbore; and one or more rams for selectively sealing the throughbore.

By providing a gripping mechanism with selective engagement, the tubing can be suspended at any point along its length.

Preferably the first gripping mechanism is a ball gripping mechanism as described in U.S. Pat. No. 2,182,797 and incorporated herein by reference. Preferably the ball gripping mechanism operates at a plurality of points around a circumference of the throughbore. In this way the load is distributed over the tubular section.

Preferably the shut off device includes a second gripping mechanism. The second gripping mechanism may be arranged on an outer surface of the body for attachment to a template or anchor.

Preferably also the shut off device includes a third gripping mechanism. Preferably the first and third gripping mechanisms are oppositely arranged on the circumference such that each can bear a load in the opposite direction.

Preferably the gripping mechanisms are remote controlled. The ball gripping mechanisms may be controlled by one or more hydraulic pistons, which provide selective positioning of balls against the tubular section to grip thereto.

Preferably the one or more rams comprise pairs of shear rams located perpendicular to the throughbore and opposite each other. More preferably there are dual pairs of shear rams to provide a back-up if the first set fail. Advantageously the shear rams are as described in Applicants co-pending Application, GB 0512995.2. Such rams have a dual operation, first in crushing the tubular and secondly in severing the tubular. In this way they can reliably sever and seal through a tubular in which a further tubular is located.

Preferably the shut off device includes a first seal on the circumference of the throughbore. More preferably the first seal is at a lower end of the shut off device. This creates a seal between the casing string and the shut off device to prevent cutting returns from entering the shut off device. This first seal may be a low pressure seal.

Preferably the shut off device includes two or more second seals located on the circumference of the throughbore. These seals are effectively a packer to create a high pressure annular seal between the tubing and the shut off device. Preferably the second seals are extruded seals. These seals may be activated by inflation of a packing element, by the extrusion of an elastomer activated by means of a hydraulic piston, or an extruded metal to metal seal. Advantageously, pistons used to compress the seals may also be used to operate the gripping mechanisms.

Preferably the shut off device includes pressure testing means such that the second seals can be pressure tested in situ. The pressure for testing may be supplied by an Electro-hydraulic, Multiplexed, Remote Operated Vehicle (ROV). Alternatively the pressure for testing may be delivered by an acoustic control system.

Preferably the shut off device includes a re-entry hub at an upper end thereof. The hub may comprise a sleeve located against the circumference of the throughbore. The sleeve may include a curved inner surface to distribute the bending loads which may be applied to the casing.

Preferably the shut off device includes a conventional wellhead profile mating surface at the upper end thereof.

In this way, if the casing has to be severed, a conventional wellhead connector can be mounted on the shut off device to re-establish the well.

BRIEF DESCRIPTION OF THE DRAWINGS

Embodiments of the present invention will now be described, by way of example only, with reference to the accompanying drawings, of which:

FIGS. 3(*a*)-(*c*) are schematic illustrations of a shearing mechanism for use in the shut off device of the present invention;

DESCRIPTION OF THE PREFERRED EMBODIMENT

Figure 1:
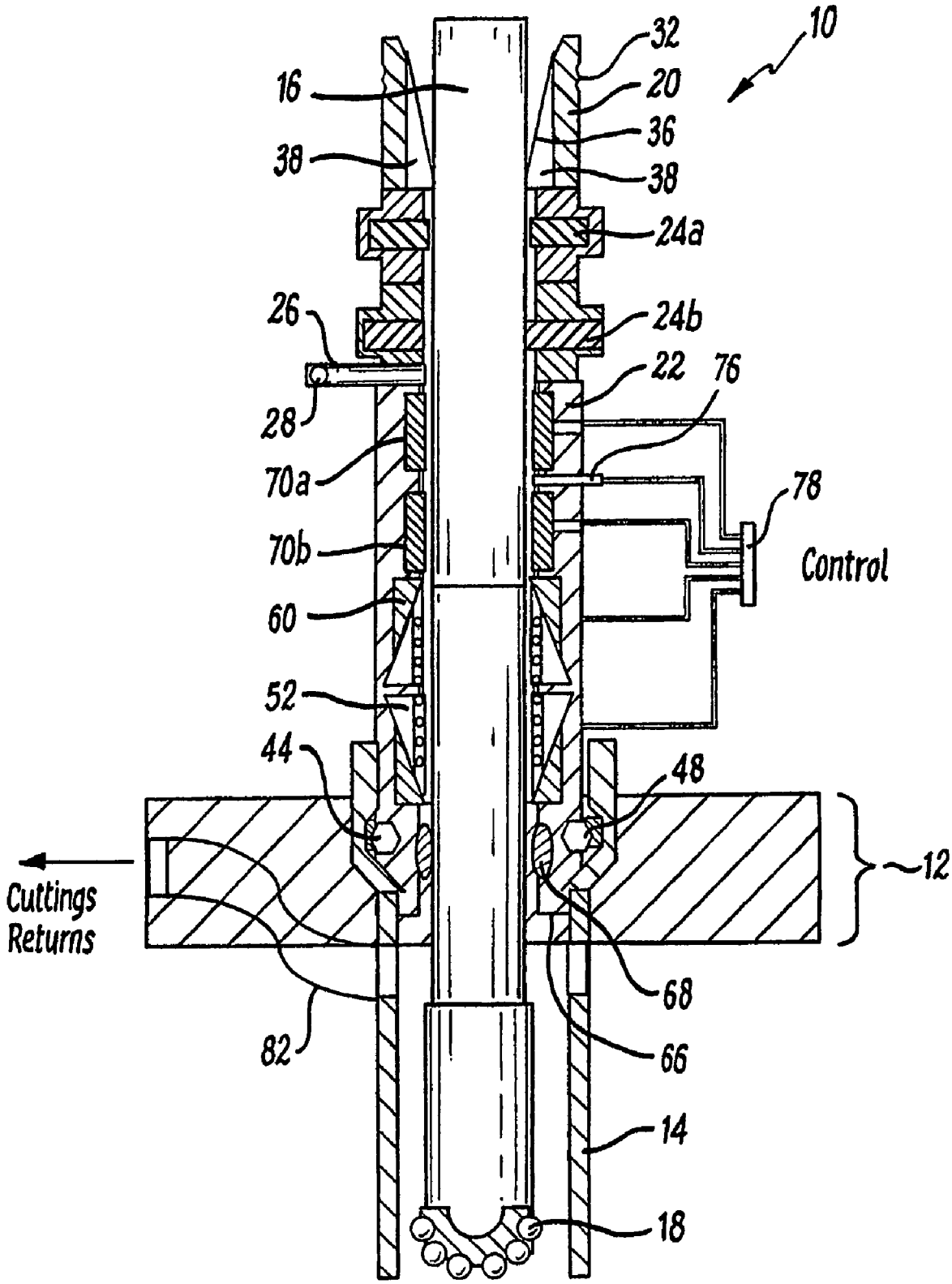
FIG. 1 is a schematic illustration of a shut off device and a method of drilling a subsea well according to an embodiment of the present invention.

Reference is initially made to FIG. 1 of the drawings which illustrates a shut off device, generally indicated by reference numeral 10, for use in drilling a subsea well according to an embodiment of the present invention. The device 10 is shown together with a template 12, casing section 14 and a casing string 16 complete with drillshoe 18.

The shut off device 10 comprises upper 20 and lower 22 housings. The upper housing 20 comprises a dual set of 13-⅝" shear rams 24*a,b*. A side outlet 26 with a non-return valve 28 provides the means of connecting a kill line with an ROV (Remotely Operated Vehicle) as is known in the art. At the top 30 of the device 10 is a 13-⅝" re-entry hub 34 with the machined profile 32 of an industry standard external wellhead connector. Internally, a bellmouth 36 fabricated from composite material, in the form of a sleeve 38, provides a means of distributing the bending loads on the 7-⅝" casing 16 located therethrough.

Figure 2:
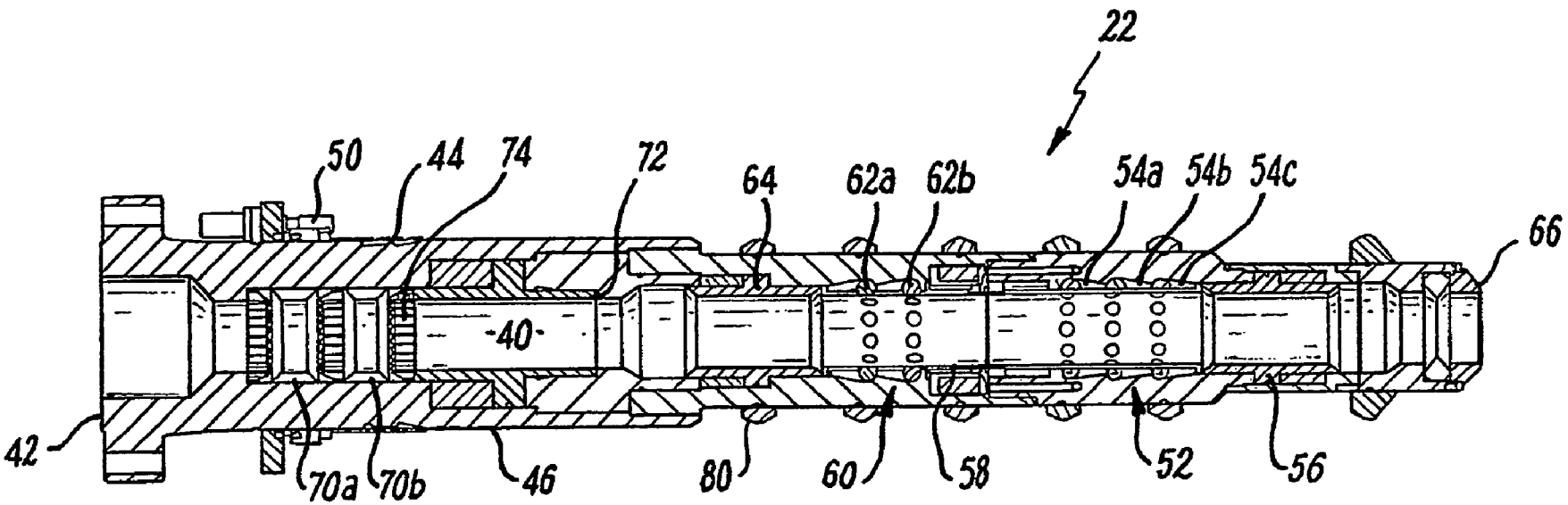
FIG. 2 is a cross sectional view through a portion of a shut off device according to a further embodiment of the present invention.

The lower housing 22 is bolted directly to the upper housing 20. An example lower housing 20 is illustrated in FIG. 2 with like parts to FIG. 1 given the same reference numeral to aid clarity. The housings 20,22 provide a continuous throughbore 40 for the 7-⅝" casing string 16 to freely pass. To provide a clear unobstructed passage for the drilled-in 7-⅝" casing 16 and its 8-½" OD connectors, the throughbore is 9" ID.

At an upper end 42 of the housing 22 is located a gripping mechanism 44 on the outer surface 46 thereof. This is as illustrated in FIG. 2. The gripping mechanism 44 of FIG. 1 is shown optionally towards the lower end 66 of the housing 22. Gripping mechanism 44 provides a means of connecting the device 10 to the template 12. This is done by means of an external male ball-gripping mechanism of the type described by Dillon in U.S. Pat. No. 2,182,797. The ball gripping mechanism 44 comprises a surface of tapered sections in each of which a ball can travel on the tapered edge. A ball cage is biased, via springs for example, to constrain the balls within the tapered sections. The balls thus travel in the tapers, constrained by the ball cage. When the balls travel down the tapers they grip the inner surface 48. To retract them, the ball cage is moved so that the balls can retract into pockets within the tapered sections. It is contact between the cage and a hydraulic piston which causes movement of the cage to retract the balls and thus release the template 12 when required.

The gripping mechanism 44 allows automatic connection and hydraulic disconnection from the template 12. The latter is achieved by means the hydraulic cylinder actuators 50.

Located on a circumference 58 of the throughbore 40 is a female lower ball-gripping mechanism 52. Mechanism 52 has three rows of tapered ball-gripping sections 54*a,b,c*.

While three rows are used, it will be appreciated that any number may be incorporated, as can any number of balls and cages in each row. Mechanism 52 operates as described above with reference to mechanism 44. Mechanism 52 is used to grip the casing string 16 and support the load of the device 10, template 12 and casing section 14 during deployment and recovery. This mechanism 52 functions to suspend the casing string 16 at the seal floor and in the event of an emergency disconnection, support the full force applied by 5,000 psi wellbore pressure, (7,500 psi Test) acting on the entire end area of the casing 16. This is set and released by an acoustic signal operating a hydraulic cylinder 56.

Also located on the circumference 58 of the throughbore 40 is a female upper ball-gripping mechanism 60. Mechanism 60 has two rows of tapered ball-gripping sections 62*a,b*. These can be released on acoustic command from the surface to direct hydraulic fluid to an actuator piston 64. These are used to engage the casing string 16 to deploy the load of shut off device 10 to the seafloor.

Also located within the lower housing 22 at the lower end 66 thereof is a low pressure seal 68. This provides a seal between the circumference 58 and the casing string 16 so that cuttings solids are prevented from entering the device 10. Seal 68 is an environmental seal fabricated from a special flexible elastomer material to allow the passage of externally upset connectors.

Also located on the circumference 58, towards the upper end 42 of housing 22 are dual seals 70*a,b* that bridge the gap between the 9" throughbore 40 and the body of the 7-⅝" drilled casing string 16. These seals 70*a,b* are extruded by means of a hydraulic piston 72 that locks in place once actuated to prevent the seals 70 from being inadvertently relaxed. Integral collet fingers 74 provide the means of backing up the elastomers of the seals 72 and prevent their extrusion under pressure load. The dual seal 70*a,b* can be pressure tested by means of a port 76 between the seals 70 as is known in the art. The port 76 is connected to an ROV interface 78 to achieve this.

The housing 22 has porting to allow the passage of the hydraulic lines from the ROV interface 78 to operate the above described functions. These lines are set in a groove at the top 42 of the housing 22 and laid underneath a series of protective "donuts" 80 to the required port.

Four point strain gauges built into the insert 38 and at template 12, allow the tensile and bending loads to be monitored and transmitted via a broadband acoustic control system to surface.

The device 10 is deployed in one trip on the drilled-in casing string 16, in this case 7-⅝" OD. However, sizes up to 9-⅝" and beyond are equally feasible. Typically the casing string 16 is equipped with a Weatherford Drill Shoe 18 which can be extruded and allow further drilling through it once total depth has been reached. Other casing drilling methods can also be used.

In use, a short section of 13⅜" casing 14 is swedged to a 22" receptacle installed in the anchor base or template 14. The lower housing 22 is installed and connected to the 22" receptacle. Dual 4" OD return lines 82 from the casing section 14 through the template 14, will ensure that cuttings are routed away from the critical seals 70 and gripping mechanisms 44, 52, 60 by diversion at the seal 68, when the device is deployed.

This larger casing section 14 with the attached template 12 provides structural support for the shut off device 10, both when the well is established and during the process of drilling in the main casing.

The shut off device 10 is normally run through the water column suspended from the 7-⅝" or similar casing string 16 by means of the upper retractable gripping mechanism 60. Once the shut-off device 10 is at the sea floor, fluid is circulated through the casing string 16 and the drill-shoe 18 to jet the larger diameter casing section 14 in place. Once the template 12 is installed at the sea floor and is self supporting, the upper retractable gripping device 60 can be released from the drilled-in casing section 16 and drilling commenced via the shoe 18.

During drilling the flexible low pressure seal 68, prevents cutting returns from entering the shut-off device 10. The cuttings and fluid circulation from the drilling annulus is routed into the one or more tubes or return lines 82 that direct them away from the template 12.

On drilling the casing string 16 to the desired depth, a cementing head can be rigged up in a fixed position with respect to the vessel, whilst the casing string 16 reciprocates through the shut off device 10, an advantage of this system. The casing string 16 is cemented in place and the drill shoe extruded. Cement returns are prevented from entering the shut-off system by means of the low pressure seal 68.

At the appropriate position the casing string 16 is spaced out and supported by means of the lower retractable gripping mechanism 60 that operates in the reverse direction to the upper gripping mechanism 60. Once supported at the seafloor in this way, the casing string 16 must be properly tensioned at the surface with conventional hydro-pneumatic riser tensioners.

The dual seal 70 is activated by means of a control system that either provides hydraulic pressure to inflate the seals, or operates a piston that compresses and extrudes the elastomer and or metallic seals. Generally in the latter method of setting the seals metallic anti-extrusion rings prevent the seal from excessive deformation under pressure.

The dual seals 70 are pressure tested via a hydraulic line and chamber between the seals accessable at the port 76. In the event of a leak in these seals a Remote Operated Vehicle (ROV) can be used to pump a small volume of liquid sealant from a reservoir onboard the ROV.

Thus the high pressure casing string 16 used for drilling is converted into a riser, fixed at the seafloor and held in tension to prevent buckling. The casing 16 will exit the shut-off device 10 at the re-entry hub 34. This is a standard subsea connector hub with an outer machined profile 32 to accommodate an industry standard, hydraulically operated connector. Normal vessel movement will cause bending and potential fatigue of the casing at this point. This fatigue will be minimised by inserting a sleeve 38 inside the re-entry hub 34. The sleeve 38 will be shaped 36 so as to distribute bending loads and prevent point loading fatigue on the casing/riser. Alternately a suitable profile may be machined inside the re-entry hub 34.

The casing string 16 is thus captured and sealed within the subsea shut-off device 10. This is normally achieved after installing and spacing out a surface BOP.

The surface BOP is used for primary well control, but in the event that an emergency disconnection is required, the dual shear rams 24 can cut the 7-⅝" casing 16 and seal in the well. Under normal circumstances it will not be necessary to use the rams 24 of the shut off device 10. However, in the event of an emergency disconnection being required, the lower shear rams 24*b* can be activated in the known manner to sever the 7-⅝" (or similar size) casing 16.

In the event of failure of the lower shear rams 24*b* the upper shear rams 24*a* will be activated. Typically the shear rams 24*a,b* will be 13-⅝" in bore but this will depend on the size of casing 16 to be sheared.

In the worst case scenario, there will be wellbore pressure inside the casing string 16, the type and configuration of shear rams 24 selected will ensure a seal after performing the shearing action.

Also in the worst case scenario any internal drill string or casing located within the casing string 16 must be severed in addition to the casing string 16. The shear rams 24 are as described in Applicants co-pending Application, GB 0512995.2. Such rams have a dual operation, first in crushing the casing and secondly in severing the casing. In this way they can reliably sever and seal through a casing in which a further casing or string is located.

The wellbore pressure will be applied to the annular seals 70, the design of which will further compress them augmenting the seal.

A considerable downward force on the casing, created by wellbore pressure will be reacted by the upper gripping mechanism 60.

After the casing 16 has been severed and the well sealed with the shear rams 24, it can be reconnected by deploying a conventional wellhead connector attached to casing or a conventional riser. The conventional wellhead connector may have a VX, AX or similar metal to metal seal.

After reconnection, surface well control capabilities can be re-established and the shear rams 24 opened, before the riser is lowered to the severed end of the casing 16.

To plug and abandon the well, a cutting tool or explosives are used to cut the casing 16 below the lower gripping mechanism 52. Then the remotely operated gripping mechanism 44 is released from the template 12.

The shut off device 10 and casing string 16 are pulled through the water column back to the vessel.

In order to achieve successful disconnection of the casing 16 from the well in emergency conditions, such as when the vessel moves off the well, a shearing mechanism in the form of a radial cutting system 84 is located within the shut off device 10. The advantage of this is that for routine disconnections, a clean radial can be performed on the casing 16 instead of the crimped cut of traditional shear rams. One such device is illustrated in FIG. 3 and will be incorporated into a pressure containing housing 86. A series of knives 88 that contact and indent the surface of the casing 16 are arranged in radial fashion on a rotating gear plate 90 supported by suitable bearings 92. The knives are hinged 94 and are driven successive inwards on a cam based system with each rotation, until the cut through the casing 16 is made.

A gear 96 is used to turn the rotating gear plate 90 at a suitable speed. This is connected to a drive shaft 98 that exits through the pressure containing housing 86. The drive shaft 98 will connect to a suitable reversible electric or hydraulic motor. Reversing the motor returns the blades to their original retracted position.

Alternatively one may create a cut with a diamond impregnated wire driven by a suitable pulley.

Figure 4:
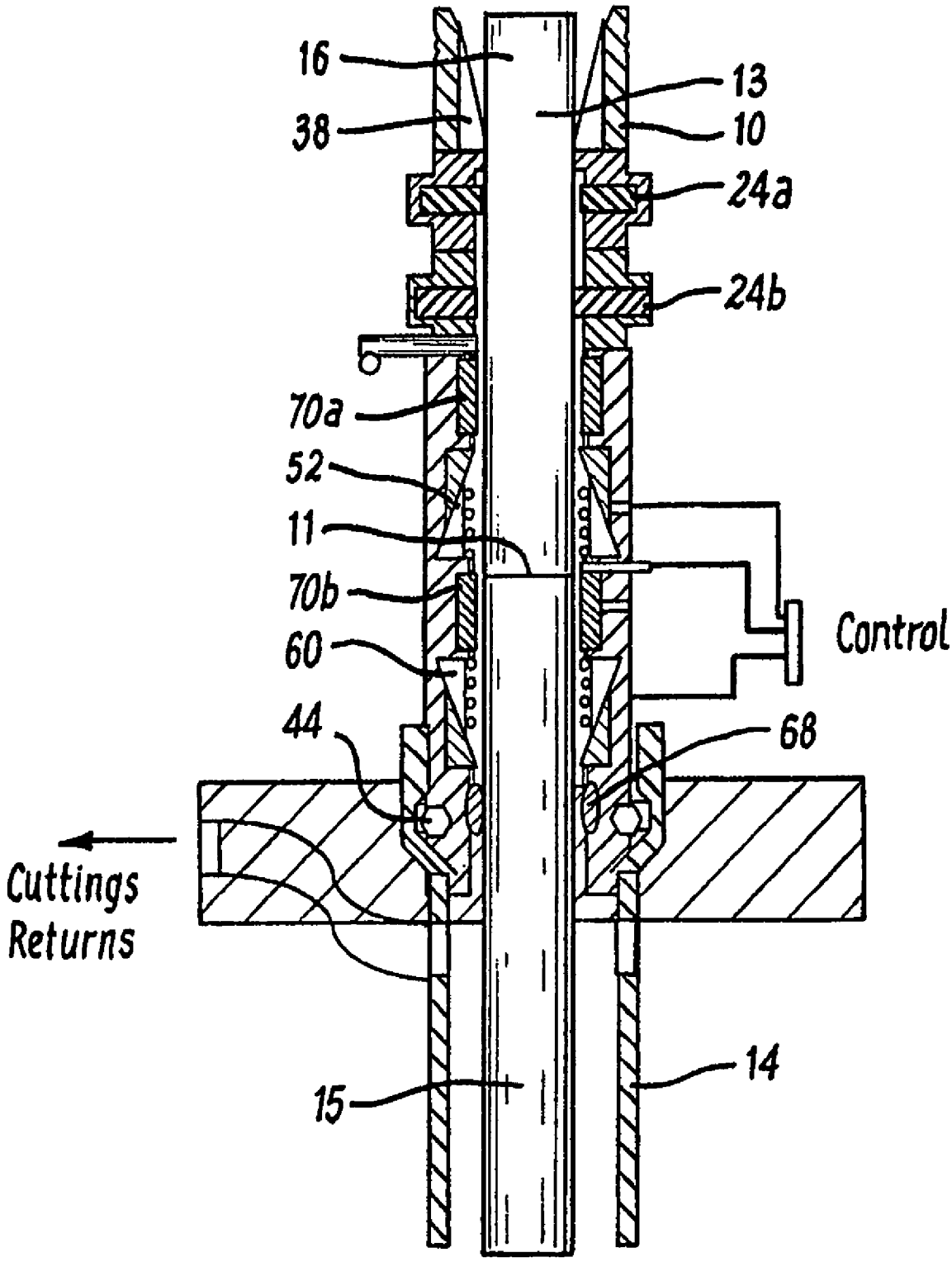
FIG. 4 is a schematic illustration of an alternative embodiment of a shut off device according to the present invention.

Reference is now made to FIG. 4 of the drawings which illustrates a shut off device and method of drilling a subsea well according to a further embodiment of the present invention. Like parts to those of FIGS. 1 and 2 have been given the same reference numeral. In this embodiment the first 52 and third 60 gripping mechanisms have been reversed and the third gripping mechanism 60 now lies between the seals 70*a,b* of the packer. This arrangement provides an advantage in that a weak point 11 in the casing 16 may be positioned above the lower seal 24*b*.

Figure 5A:
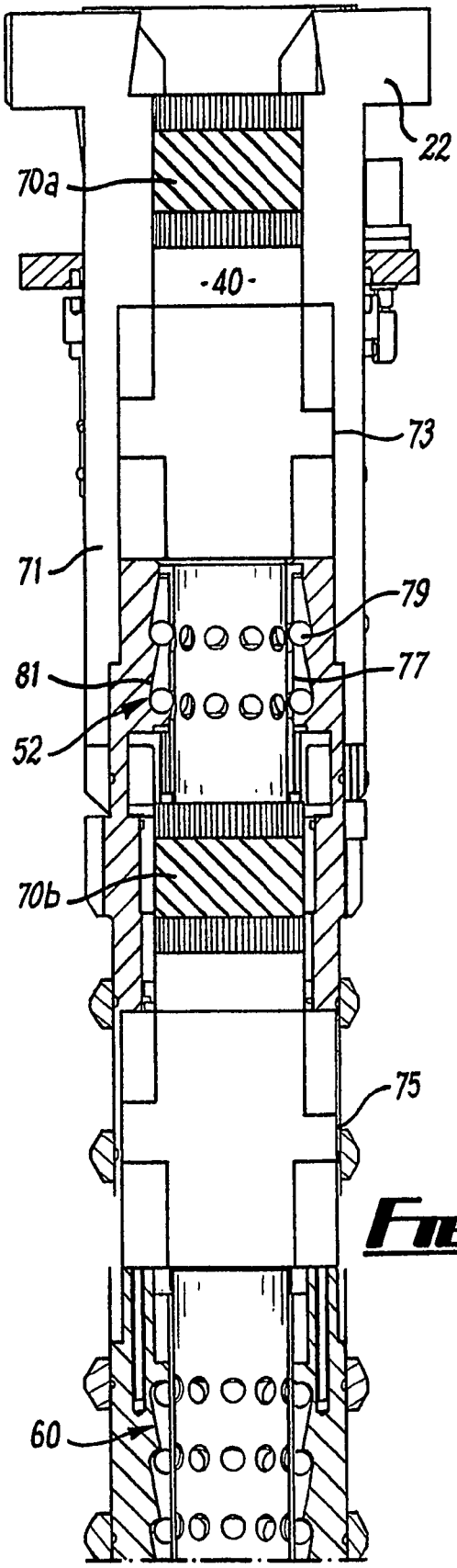
FIGS. 5(*a*) and (*b*) are schematic cross sectional views through a portion of a shut off device according to a further embodiment of the present invention.
Figure 5B:
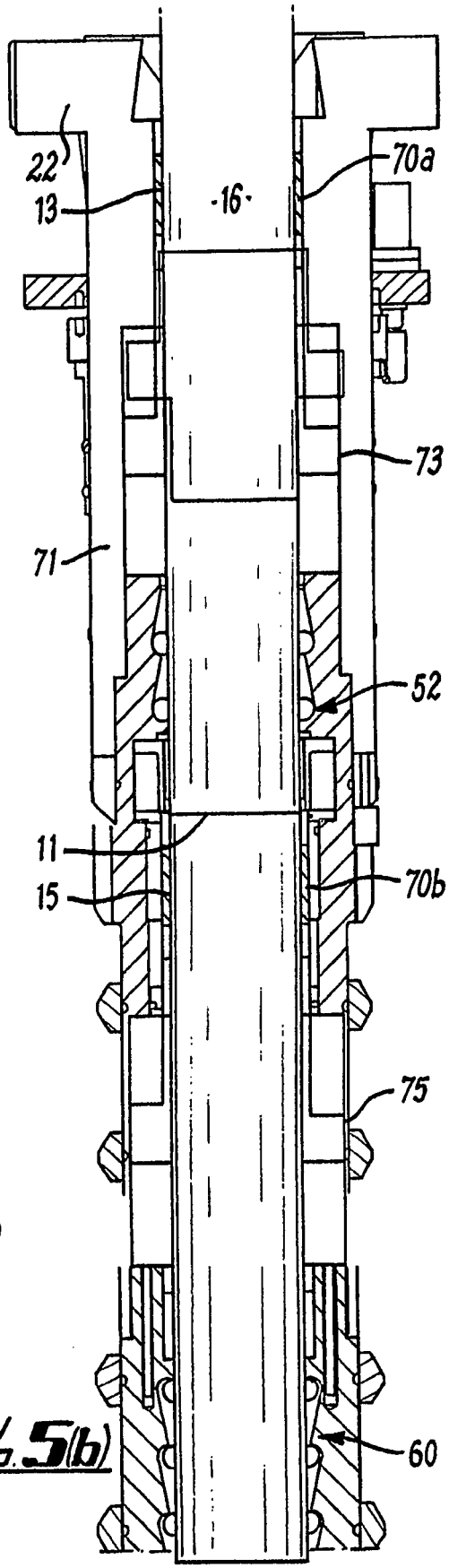
Figure 6A:
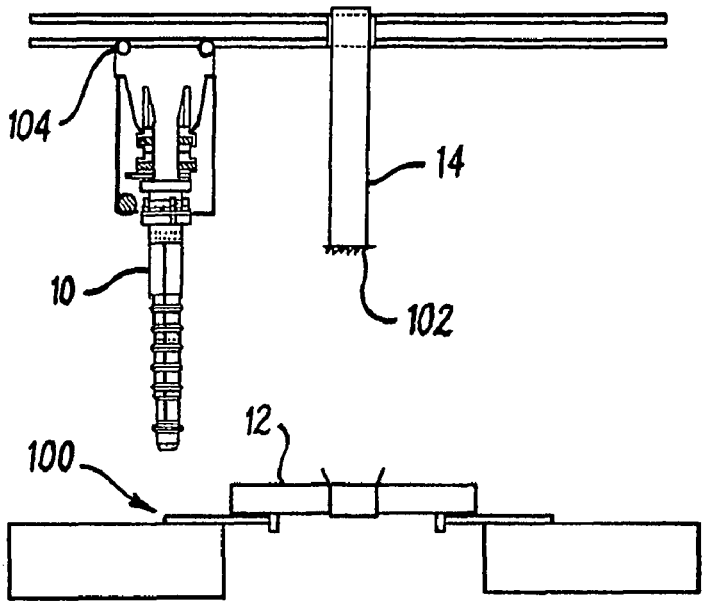
FIGS. 6(*a*)-(*e*) are schematic illustrations of a method of drilling a subsea well according to a second embodiment of the present invention.
Figure 6B:
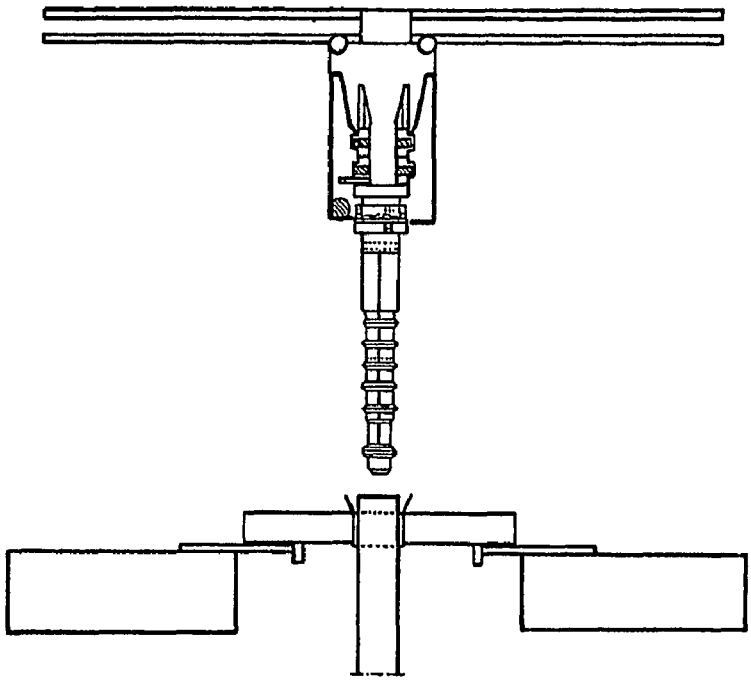
Figure 6C:
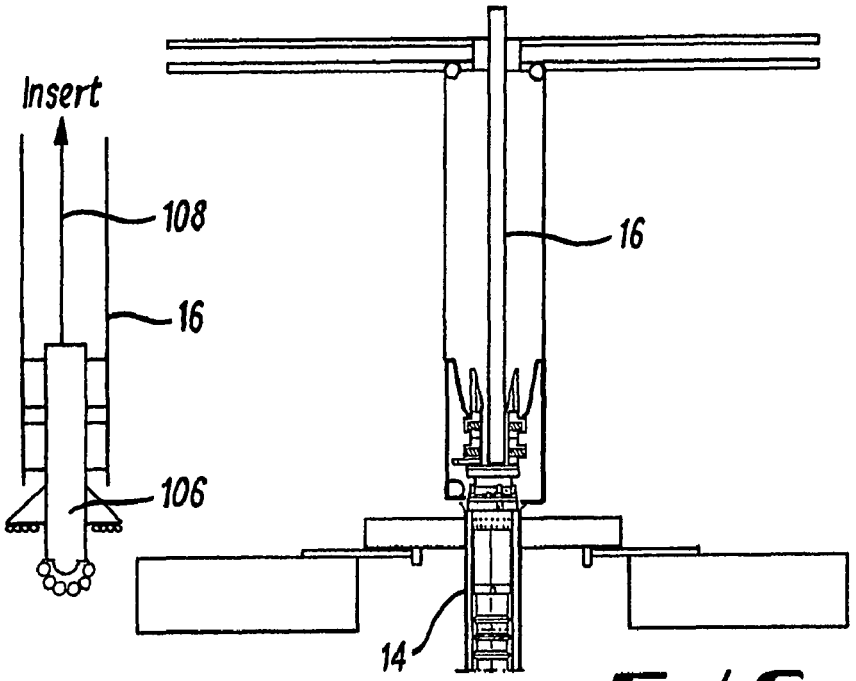
Figure 6D:
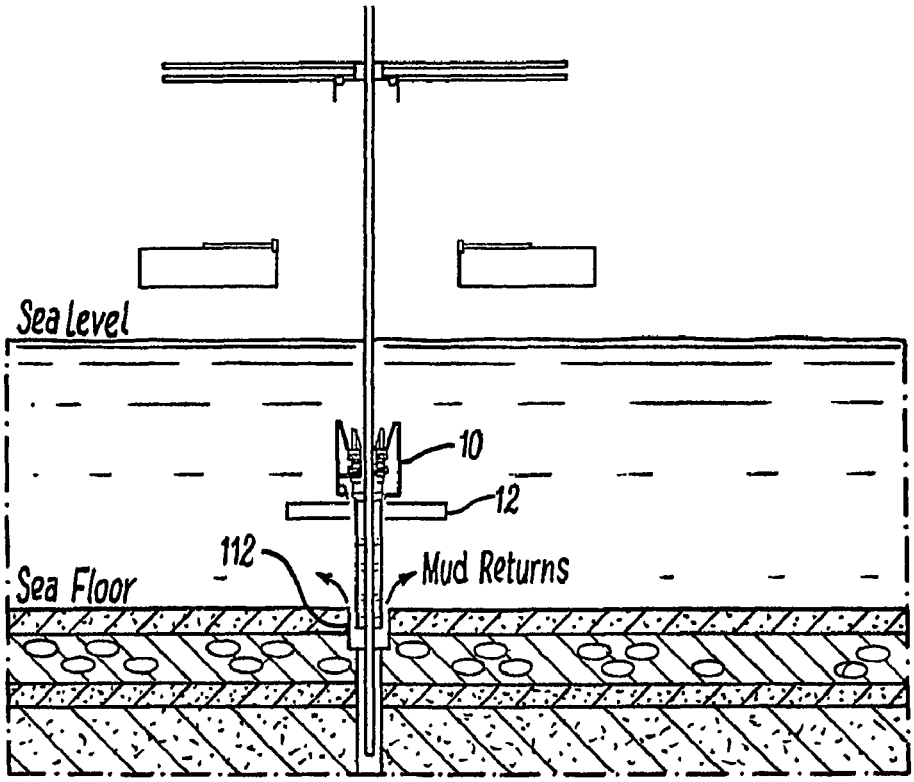
Figure 6E:
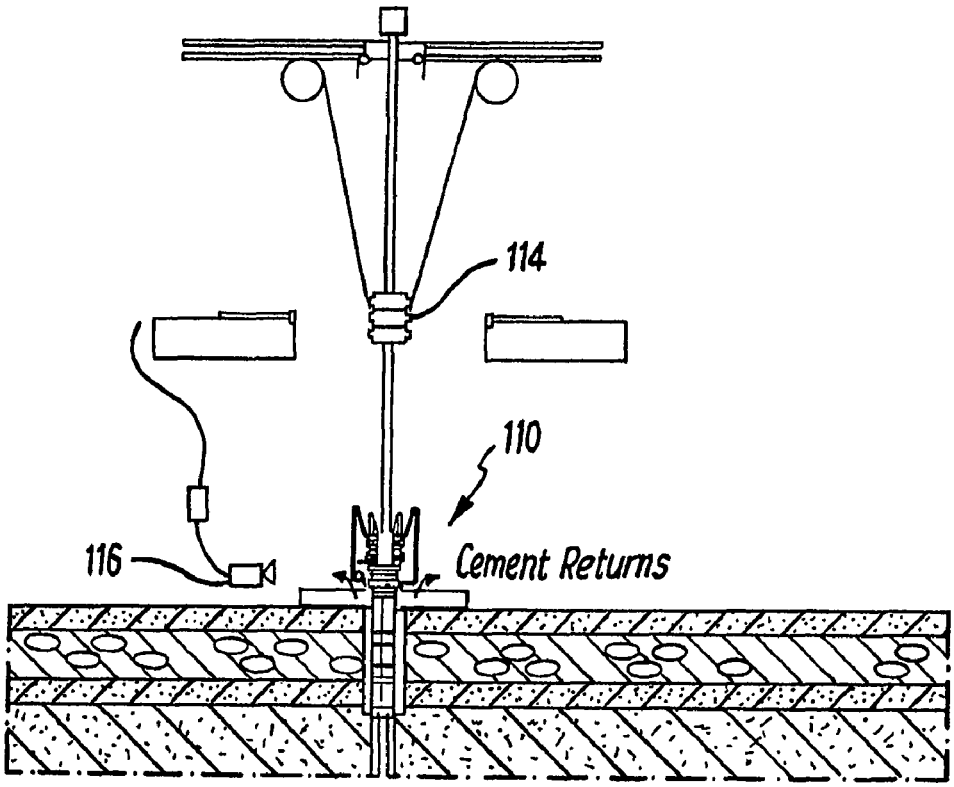

This can better be seen with the aid of FIG. 5. FIG. 5 illustrates the dual piston arrangement used to operate the gripper/seal pairs. Like parts to those of the earlier figures have been used. Referring to FIG. 5(*a*), upper piston 73 is arranged to move in the bore 40 such that in one direction it compresses the seal 70*a* and a spring return, within each of the ball/cage arrangements of the gripper mechanism 52, drives the balls down the taper causing the balls to grip the casing 16. Thus the piston 73 can be considered to be dual acting.

Conversely if the piston 73 is actuated and moved away from the seal 70*a* to relax and release the seal 70*a*, the piston 73 is then used to depress the ball cage 77 and allow the balls 79 to retract into their pockets 81 and release the casing 16. The two positions of the piston 73 are illustrated in FIG. 5(*b*) were the casing 16 is also shown. The lower piston 75 works in the same way as the upper piston 73, providing a dual action on the gripper 60 and the seal 70*b*.

These pistons 73,75 provide for the actions of combined gripping and sealing on each section 13, 15 of the casing 16 on either side of the weak point 11. This allows for easy disconnection and reconnection of the upper part of the casing 13, whilst maintaining pressure integrity of the well-bore on the lower part of the casing 15. The upper and lower shear rams 24 are closed after the disconnected casing is released. Closing of the rams 24 is independent of the casing 16 and thus the crushing effects of the rams is avoided.

In this embodiment, the operator may wish to run the shut off device 10 to the seafloor, drill in and cement the casing 16 and then after connecting up and tensioning the casing 16 at the surface cut the casing 16 above the lower seal 24*b*. This casing cut could be made by a variety of existing cutting tools that allow precise space out of the cut. One such tool is illustrated in FIG. 3.

By having a weak point or cutting the casing as described above, the operator can disconnect and reconnect more easily than with the previous embodiment.

The embodiments of the method in which the casing section 14 is jetted into the sea floor, are typically suitable for sea beds of relatively soft material. For application in firmer sea beds such as those of the North Sea and East Coast of Canada an alternative embodiment is described herein with reference to FIG. 6. Like parts to those of FIGS. 1 and 2 have been given the same reference numeral to aid clarity and maintain consistency.

In this the shut off device 10 is placed in the moon-pool area of the rig or as illustrated in FIG. 6(*a*) in the cellar deck area of the rig on the skid beams 100. Such an arrangement is typical of a semi-submersible rig where the rig floor level is typically 8-9 metres above the cellar deck area.

First a template 12 is picked up and installed on the rig skid beams 100. A short section of 22" conductor casing 14 is picked up and run through the rotary table and landed out and secured to the template 12. This conductor casing 14 has a serrated end 102 or shoe typically with applied tungsten carbide to it, to provide toughness.

The template 12 is secured to the retractable skid beams 100 by means of tension bolts, tensioned slings or other temporary fixation methods. These fixings must resist forces generated by the movement of the drilling vessel.

The subsea shut off device 10, is first suspended from the overhead gantry crane 104, and then moved into position over the template 12 and then lowered down into the conductor casing 14 and connected by the ball-gripping mechanism 44. This is illustrated in FIGS. 6(*b*) and (*c*).

With the subsea shut-off device 10 secured in place, casing 16, typically 7-⅝" in diameter, is then lowered through the shut-off device 10. Casing drilling will be conducted using a system with a removable bottom hole assembly 106 with an under-reamer and bit as is the current art. This assembly is run and secured inside the 7-⅝" casing 16 before drilling starts. This is illustrated in the insert picture in FIG. 6(*c*).

The well is started (spudded) using the casing drilling assembly 106. Drilling continues by connecting more joints of casing and then rotating the casing 16 through shut off device 10 which is secured in the cellar deck area. On reaching the first surface casing point, the bottom hole assembly 106 used for drilling is disconnected from the casing 16 and removed by means of coiled tubing or wire-line 108. This illustrates the advantage of using this method of casing drilling in that if the bit or cutters are prematurely worn before reaching the desired depth, the bottom hole assembly 106 can be removed to surface and a new bit or cutting structures installed.

At this point the casing 16 used for drilling is pulled out of the hole. The length pulled out will be equivalent to the water depth on the drilling location.

Next, the shut off device 10 is attached to the casing 16 by means of the upper and lower ball-gripping mechanisms 52, 60 and the annular seals 70 extruded and pressure tested as required. The entire assembly 110 is lowered to the seafloor attached to the casing 16 whilst circulating drilling mud into the well at a high rate. Mud returns are circulated to the sea floor. This is illustrated in FIG. 6(*d*).

When the shut-off device 10 attached to the conductor casing 14 arrives at the seafloor, it is reciprocated gently. The force on the toughened shoe 102 of the conductor casing 14 creates a pocket 112 in the seafloor in which to place the 22" conductor 14. Cuttings created from this reciprocation are removed by the circulating mud returning up the annulus.

When the template 12 is able to land at the correct height on the seafloor to support the shut off system 110, a surface BOP stack 114 is installed on the top of the 7-⅝" casing 16 and is tensioned on the vessel to compensate for vessel motion in the normal way. This is illustrated in FIG. 6(*e*).

Cement is now pumped through the 7-⅝" casing 16 and is extruded back up into the annulus to the seafloor where a Remotely Operated Vehicle (ROV) 116 will provide positive identification that the well bore has good cement returns to seafloor into the annulus.

Drilling can now continue inside the surface casing 16 which now forms the riser to surface at the vessel.

Figure 7:
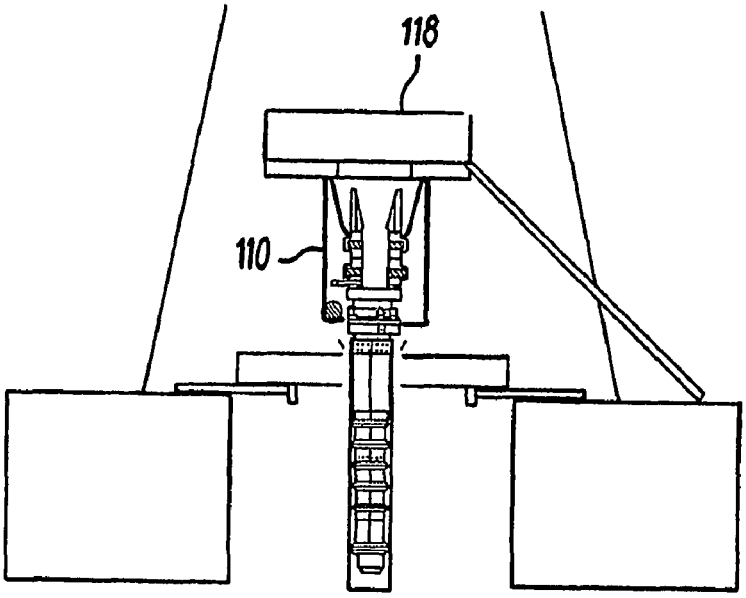
FIG. 7 is a schematic illustration of a method of drilling a subsea well according to a third embodiment of the present invention.

Another embodiment of this invention is where the shut-off system 110 is deployed from a mono-hull vessel where there is no cellar deck. In this, the shut-off system 110 is installed over the moonpool and work of connecting and running the casing 16 is carried out on a platform 118 constructed on top of the shut-off system 110. This is illustrated in FIG. 7.

Figure 8:
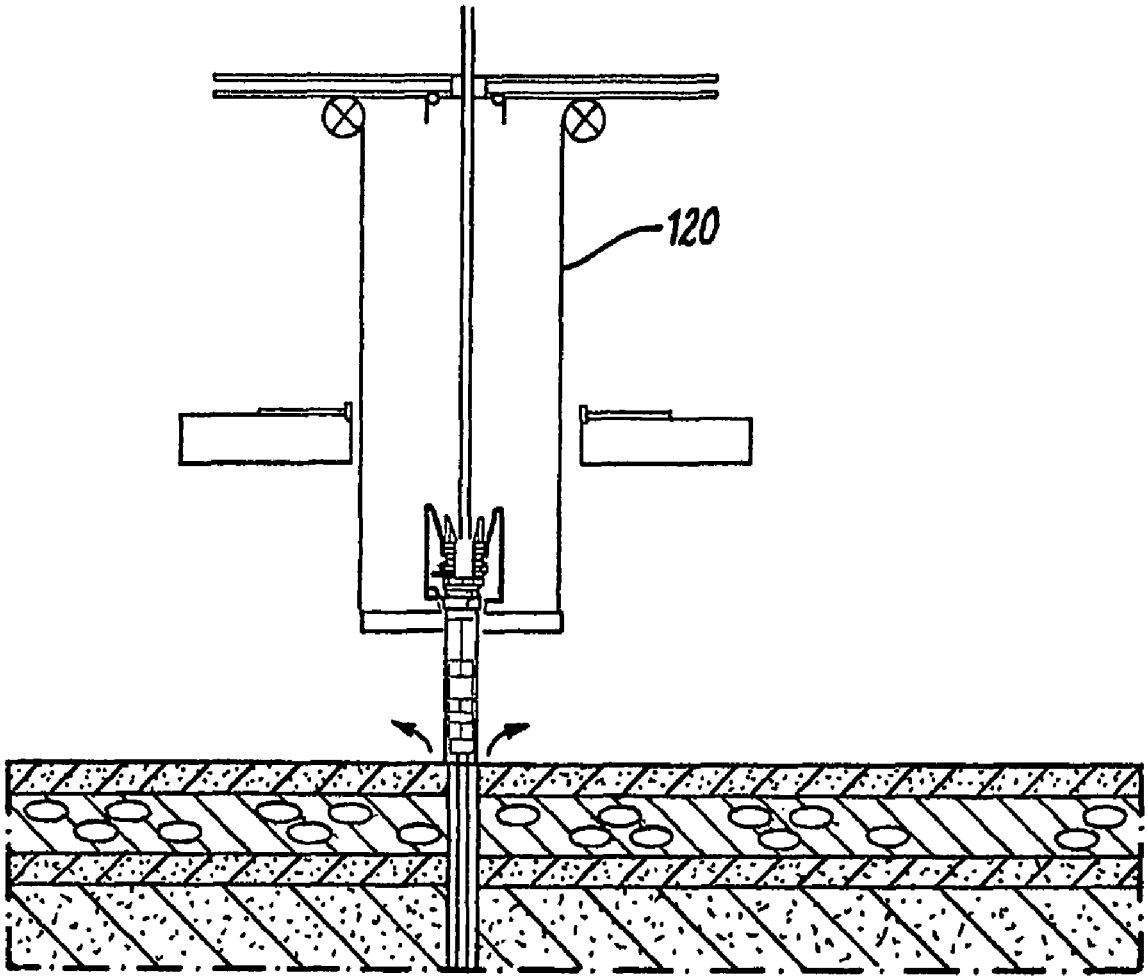
FIG. 8 is a schematic illustration of a method of drilling a subsea well according to a fourth embodiment of the present invention.

A further embodiment of this invention is in lowering the shut-off system 106 down to the seafloor on the rig tensioned guidelines 120 typically 2 or 4 in number. The method is illustrated in FIG. 8. In this case the ball-gripping mechanisms 52, 60 and annular seals 70 are activated remotely by means of the control system either using an acoustic modem or though an umbilical connected to surface.

A principal advantage of the present invention is that it provides a method and apparatus for drilling a subsea well wherein the drilled casing to be suspended at any point along it's length.

A further advantage of the present invention is that it enables slim, "finder wells" to be established in deepwater with drilled-in casing. By minimising the loads that must be supported by the vessel, the operator has a much greater choice of vessels for a given water depth. This can reduce exploration well costs by more than 50% when compared to the cost of deploying a "conventional" approach.

A yet further advantage of the present invention is that it provides a subsea well with a riser to surface on a single trip. This will speed up the operation and reduce the risk. Yet further it eliminates the conventional wellhead and combines the advantages of slim, drilled-in surface casing with the ability to disconnect the well at the seafloor.

The invention claimed is:

1. A method of drilling a subsea well comprising the steps:

a) providing a subsea shut off device including a throughbore, a first gripping mechanism for selective attachment along a length of a casing when located in the throughbore and one or more rams for selectively sealing the throughbore in an emergency;

b) providing the casing upon which the shut off device is attached thereto by the first gripping mechanism;

c) running the casing with the shut off device from the surface to the sea floor;

d) disconnecting the casing from the shut off device;

e) using the casing to drill the well from the sea floor.

2. A method of drilling a subsea well according to claim 1 wherein the method includes the step of re-engaging the first gripping means during drilling of the well.

3. A method of drilling a subsea well according to claim 1 wherein the method includes the step of attaching a template to the shut off device at the surface.

4. A method of drilling a subsea well according to claim 3 wherein the template is attached to an outer surface of the shut off device by a second gripping mechanism.

5. A method of drilling a subsea well according to claim 4 wherein the first and second gripping mechanisms are ball gripping mechanisms.

6. A method of drilling a subsea well according to claim 3 wherein the method includes the step of suspending a section of casing from the template.

7. A method of drilling a subsea well according to claim 6 wherein the method includes the step of jetting the section of casing into the sea floor.

8. A method of drilling a subsea well according to claim 1 wherein the method includes the steps of:

a) supporting the shut off device on a vessel;

b) running the casing string through the shut off device;

c) drilling a portion of the subsea well from the casing string; and d) raising the casing string towards the shut off device.

9. A method of drilling a subsea well according to claim 8 wherein the method includes the step of locating a shoe at an end of casing section and reciprocating the casing section in the well.

10. A method of drilling a subsea well according claim 1 wherein the method includes the step of locating an extrudable drill shoe on the end of the casing string.

11. A method of drilling a subsea well according claim 1 wherein the method includes the step of activating a first seal at a lower end of the shut off device.

12. A method of drilling a subsea well according claim 1 wherein the method includes the steps of spacing out the casing string and supporting the casing by a third gripping mechanism.

13. A method of drilling a subsea well according to claim 12 wherein the method includes the step of tensioning the casing string at the surface.

14. A method of drilling a subsea well according claim 1 wherein the method includes the step of activating two or more second seals to create a high pressure seal between the casing string and the shut off device.

15. A method of drilling a subsea well according to claim 14 wherein the method includes the step of pressure testing the second seals.

16. A method of drilling a subsea well according claim 1 wherein the method includes the step of inserting a drill string through the casing string to drill from the end thereof.

17. A method of drilling a subsea well according claim 1 wherein the method includes the step of activating a lower set of shear rams, of the one or more rams, to shear the casing string and seal the through bore.

18. A method of drilling a subsea well according to claim 17 wherein the method includes the step of activating an upper set of shear rams, of the one or more rams, to shear the casing string and seal the through bore in the event of failure of the lower shear rams.

19. A method of drilling a subsea well according to claim 1 wherein the method includes the steps of:

a) locating a weak point of the casing string between the first and third gripping mechanisms and between the second seal, with the third gripping mechanism arranged above the first and between the second seals;

b) disengaging the third gripping mechanism and the upper second seal;

c) severing the casing string at the weak point;

d) raising the severed upper portion of the casing string above the rams;

e) closing the rams to seal the well bore.

20. A method of drilling a subsea well according to claim 17 wherein the method includes the step of holding pressure using the second seal(s) following disconnection by severing of the casing.

21. A method of drilling a subsea well according to claim 17 wherein the method includes the step of reconnecting a casing string to the shut off device to re-establish the well.

22. A method of drilling a subsea well according to claim 15 wherein the method includes the steps of plugging and abandoning the well by:

a) cutting the casing string below the second gripping mechanism;

b) releasing the first and third gripping mechanisms; and c) pulling the shut off device together with the casing section, to surface.

23. A method of drilling a subsea well according to claim 22 wherein the template is left on the sea floor by release of the second gripping mechanism.

24. A subsea shut off device for use in drilling a subsea well according to the method of claim 1, the device comprising a substantially tubular body having an axial throughbore;

a first gripping mechanism for selective engagement along a length of a casing when inserted in the throughbore; and one or more rams for selectively sealing the throughbore.

25. A subsea shut off device according to claim 24 wherein the first gripping mechanism is a ball gripping mechanism.

26. A subsea shut off device according to claim 24 wherein the device includes a second gripping mechanism arranged on an outer surface of the body for attachment to a template.

27. A subsea shut off device according to claim 26 wherein the device includes a third gripping mechanism and wherein the first and third gripping mechanisms are oppositely arranged on a circumference of the throughbore such that each can bear a load in opposite directions.

28. A subsea shut off device according to claim 24 wherein the gripping mechanisms are remote controlled.

29. A subsea shut off device according to claim 24 wherein the one or more rams comprise pairs of shear rams located perpendicular to the throughbore and opposite each other.

30. A subsea shut off device according to claim 24 wherein the device includes a first seal on the circumference of the throughbore.

31. A subsea shut off device according to claim 24 wherein the device includes two or more second seals located on the circumference of the throughbore to act as a packer.

32. A subsea shut off device according to claim 31 wherein the device includes pressure testing means such that the second seals can be pressure tested in situ.

33. A subsea shut off device according to claim 24 wherein the device includes a re-entry hub at an upper end thereof.

34. A subsea shut off device according to claim 24 wherein a surface of the throughbore includes a curved to distribute the bending loads which may be applied to the casing string.

35. A subsea shut off device according to claim 32 wherein the third gripping mechanism is arranged between the second seals and above the first gripping mechanism.

36. A method of drilling a subsea well comprising the steps:

a) providing a subsea shut off device including a throughbore, a first gripping mechanism for selective attachment along a length of a casing when located in the throughbore and one or more rams for selectively sealing the throughbore in an emergency;

b) providing the casing equipped with a bottom hole drilling assembly (BHA), and upon which the shut off device is attached thereto by the first gripping mechanism;

c) running the casing with the shut off device from the surface to the sea floor;

d) disconnecting the casing from the shut off device; and e) using the casing BHA to drill the well from the sea floor whereby the well is drilled and established on a single trip.

* * * * *